United States Patent [19]

Uemura et al.

[11] 4,397,830

[45] Aug. 9, 1983

[54] STARTING PITCHES FOR CARBON FIBERS

[75] Inventors: Seiichi Uemura, Tokyo; Shunichi Yamamoto; Takao Hirose, both of Kamakura; Hiroaki Takashima, Kawasaki; Osamu Kato, Yokohama, all of Japan

[73] Assignee: Nippon Oil Co., Ltd., Tokyo, Japan

[21] Appl. No.: 366,917

[22] Filed: Apr. 9, 1982

[30] Foreign Application Priority Data

| | | | |
|---|---|---|---|
| Apr. 13, 1981 | [JP] | Japan | 56-54304 |
| Apr. 14, 1981 | [JP] | Japan | 56-55108 |
| Apr. 27, 1981 | [JP] | Japan | 56-62427 |

[51] Int. Cl.[3] ..... D01F 9/12; C10C 3/02; C10C 3/00

[52] U.S. Cl. ..... 423/447.1; 423/447.6; 208/22; 208/40

[58] Field of Search ..... 423/447.1, 447.2, 447.4, 423/447.6; 208/3, 4, 5, 6, 7, 22, 39, 40, 44, 142, 23

[56] References Cited

U.S. PATENT DOCUMENTS

| | | | |
|---|---|---|---|
| 4,197,283 | 4/1980 | Crepaux et al. | 423/447.1 |
| 4,320,107 | 3/1982 | Oyabu et al. | 423/447.2 |

FOREIGN PATENT DOCUMENTS

| | | | |
|---|---|---|---|
| 56-26009 | 3/1981 | Japan | 423/447.1 |

*Primary Examiner*—O. R. Vertiz
*Assistant Examiner*—Steven Capella
*Attorney, Agent, or Firm*—Bucknam and Archer

[57] ABSTRACT

A starting pitch for carbon fibers, obtained by (A) mixing (1) a heavy fraction oil boiling at not lower than 200° C. obtained at the time of steam cracking of petroleum with (2) a hydrogenated oil selected from aromatic hydrocarbons of 2–10 rings in which the nuclei have been hydrogenated and specific fractions boiling at 160°–650° C. and containing such nuclei-hydrogenated hydrocarbons and then (B) heat treating the resulting mixed oil at 370°–480° C. and 2–50 Kg/cm$^2$.G to obtain the starting pitch for carbon fibers.

2 Claims, 1 Drawing Figure

STARTING PITCHES FOR CARBON FIBERS

Figure 1:
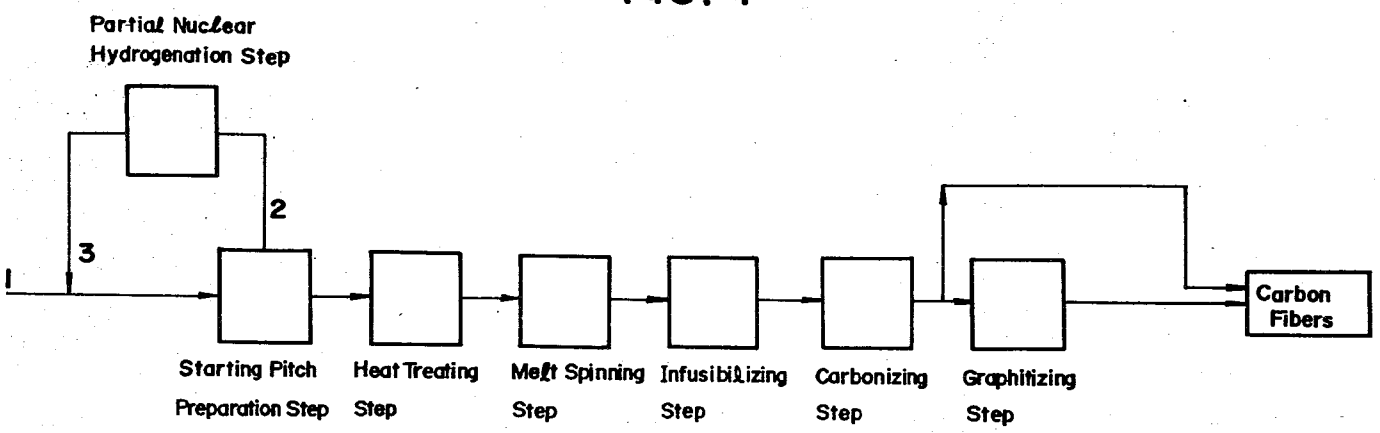

This invention relates to an excellent pitch for producing carbon fibers therefrom.

At present, carbon fibers are produced mainly from polyacrylonitrile as the starting material. However, polyacrylonitrile as the starting material for carbon fibers is disadvantageous in that it is expensive, tends not to retain its fibrous shape when heated for stabilization and carbonization and is carbonized in a low yield.

In view of this, there have recently been reported many methods for producing carbon fibers from pitch. In cases where pitch is used as the starting material for producing carbon fibers, it is expected to obtain carbon fibers at a low cost since pitch is inexpensive and may be carbonized in a high carbonization yield. However, carbon fibers produced from pitch raise a problem that they have high tensile modulus on one hand and low tensile strength on the other hand as compared with those produced from polyacrylonitrile. If, thus, a method for solving this problem and further improving the pitch-derived carbon fibers in tensile modulus is formed, such a method will render it possible to produce carbon fibers having high tensile strength and tensile modulus at a low cost from pitch.

There was recently reported a method for producing carbon fibers having improved tensile modulus and tensile strength, which comprises heat treating a commercially available petroleum pitch to obtain a pitch containing optically anisotropic liquid crystals called "mesophase" (such a pitch being hereinafter referred to as "precursor pitch" in the melt spinning step), melt spinning the thus obtained precursor pitch, infusibilizing (making infusible) the thus melt spun pitch and then carbonizing or further graphitizing the pitch so infusibilized (Japanese Pat. Appln. Laid-Open Gazette No. 49-19127).

However, it depends on various factors whether or not pitch may form liquid crystal therein. In addition, the resulting liquid cyrstals will greatly depend for their structure, softening point, viscosity and other properties on the pitch used as the starting material. Said Japanese Laid-Open Gazette No. 49-19127 discloses a method for producing a pitch containing the mesophase (such a pitch being hereinafter called "mesophase pitch"), however, it does not refer to anything about a starting pitch for producing a mesophase pitch of good quality therefrom. As mentioned before, it depends greatly on a starting pitch whether or not a mesophase pitch of good quality may be obtained therefrom. If a very desirable starting pitch is obtained, then it will be possible to produce therefrom carbon fibers having excellent tensile modulus and tensile strength. Therefore, it is an important object of this invention to provide such a very desirable starting pitch.

For example, coal tar pitch contains carbon black-like, quinoline-insoluble and infusible substances, and these undesirable substances causes the non-uniformity of the precursor pitch thereby not only degrading the spinnability of the precursor pitch but also having adverse effects on the tensile strength and tensile modulus of the resulting carbon fibers.

In contrast, many of commercially available petroleum pitches and synthetic pitches hardly contain any quinoline-insoluble and infusible substances, however, they will produce quinoline-insoluble and high molecular weight substances when heat treated to prepare a precursor pitch therefrom. More particularly, when these pitches are heat treated, they will cause both thermal decomposition and polycondensation whereby the low molecular weight ingredients gradually form quinoline-insoluble high molecular weight ones. Further, the high molecular weight ingredients so formed will, in turn, form further high molecular weight ones, accompanied with an increase in softening point of the pitches. If these quinoline-insoluble ingredients are similar to the carbon black-like substances in coal tar, they will have adverse effects in the spinning and its subsequent steps as mentioned above. In addition, even if the quinoline-insoluble ingredients are those which are different from said carbon black-like substances, the existence of the quinoline-insoluble substances in a large amount and the increase in softening point in the pitches will have adverse effects in the melt spinning step. More particularly, for melt spinning the precursor pitches, it is necessary to raise the spinning temperature to such an extent that the pitches have a viscosity sufficient to be melt spun. Thus, if the precursor pitches have too high a softening point, then the spinning temperature must naturally be raised with the result that the quinoline-insoluble ingredients form further high molecular weight ones, the pitches cause their pyrolysis with light fraction gases being evolved thereby rendering it impossible to obtain homogeneous pitches and carry out melt spinning of the pitches practically.

As is seen from the above, it is necessary that the precursor pitches have a comparatively low softening point and a viscosity suitable to enable them to be spun. Furthermore, the precursor pitches must not be such that they contain a substantial amount of volatile ingredients at the time of spinning and carbonization.

For this reason, the quinoline-insoluble ingredients are removed by filtration under a pressure, extraction with a solvent, or other suitable means to prepare precursor pitches for producing carbon fibers. However, the methods disclosed in these publications are not desirable from the economical point of view since they require complicated equipment and incur an increased cost.

It is the most preferable if there may be used, as the starting pitch, an excellent pitch which will not produce quinoline-insoluble high-molecular-weight ingredients when heated for preparing the precursor pitch.

The present inventors made intensive studies in an attempt to obtain such as excellent pitch and, as a result of their studies, they obtained an excellent pitch. More particularly, they found a starting pitch which will inhibit the production of high molecular weight ingredients, prevent an increase in softening point and be able to have a composition allowing the aromatic planes to be easily arranged in order in the step of preparing precursor pitches.

The starting pitches of this invention which may be used in a method comprising heat treating a starting pitch to obtain a precursor pitch, melt spinning the thus obtained precursor pitch, infusibilizing the thus spun pitch, carbonizing the thus infusibilized pitch and, if desired, graphitizing the thus carbonized pitch to obtain carbon fibers, may be produced by (A) mixing 100 parts by volume of (1) a heavy function oil boiling at not lower than 200° C. obtained at the time of steam cracking of petroleum with 10–200 parts by volume of (2) a hydrogenated oil selected from the group consisting of (a) aromatic nucleus-hydrogenated hydrocarbons prepared from aromatic hydrocarbons of 2–10 rings by hydrogenating the nuclei thereof, (b) a hydrogenated oil obtained by contacting a fraction boiling at 160°-650° C. obtained at the time of steam cracking of petroleum and/or a fraction boiling at 160°-650° C. produced at the time of heat treating at 380°-480° C. a heavy fraction boiling at not lower than 200° C. obtained at the time of steam cracking of petroleum, with hydrogen in the presence of a hydrogenating catalyst to hydrogenate 10-70% of the aromatic nuclei of aromatic hydrocarbons contained in said fraction boiling at 160°-650° C., and (c) a hydrogenated oil obtained by contacting a fraction boiling at 160°-650° C. produced at the time of preparing the starting pitches by heat treatment, with hydrogen in the presence of a hydrogenating catalyst to hydrogenate 10-70% of the aromatic nuclei of aromatic hydrocarbons contained in said fraction boiling at 160°-650° C., to form a mixture of the oils (1) and (2), and then (B) heat treating the thus formed oil mixture at 370°-480° C. under a pressure of 2-50 $Kg/cm^2.G$ thereby to obtain the starting pitch for carbon fibers.

In cases where the starting pitches of this invention are subjected to preparing precursor pitches, it was quite unexpectedly found that the production of quinoline-insoluble ingredients was inhibited, the pitch was reformed and the resulting final product, carbon fibers, had further high tensile modulus and high tensile strength.

In contrast, coal tar pitch, commercially available pitches and synthetic pitches were each heat treated in an attempt to carry out mesophase formation thereon in accordance with the method as disclosed in Japanese Pat. Appln. Laid-Open Gazette No. 49-19127 to obtain heat treated pitches. For example, some of the thus heat treated pitches had a softening point of 340° C. or higher, some thereof contained solid matter deposited therein and some thereof contained at least 70 wt.% of quinoline-insoluble ingredients although they contained no solid matter deposited therein; it is practically impossible in many cases to melt spin these heat treated pitches. As to some of the heat treated pitches, which could be melt spun, they were then infusibilized, carbonized and graphitized to obtain carbon fibers. The thus obtained carbon fibers, however, had a tensile strength of as low as 120-200 $Kg/mm^2$ and a tensile modulus of as low as 12-20 $ton/mm^2$. Furthermore, in a case where the heat treated pitches having a high softening point were melt spun, the resulting fibers had cavities produced due to gases evolved by pyrolysis of the pitches.

This invention will be further detailed hereinbelow.

The heavy fraction oil (1) boiling at not lower than 200° C. obtained at the time of steam cracking of petroleum according to this invention is a heavy fraction oil boiling preferably at 200°-700° C. (calculated in terms of normal pressure) obtained as a by-product at the time of steam cracking at usually 700°-1200° C. of petroleum such as naphtha, kerosene or gas oil in order to produce olefins such as ethylene and propylene.

The aromatic-nucleus hydrogenated hydrocarbons (2) (a) used in this invention include naphthalene, indene, biphenyl, acenaphthylene, anthracene, phenanthrene and their $C_{1-3}$ alkyl-substituted compounds, in each of which 10-100%, preferably 10-70% of the aromatic nuclei has been hydrogenated. More specifically, they include decalin, methyldecalin, tetralin, methyltetralin, dimethyltetralin, ethyltetralin, isopropyltetralin, indane, decahydrobiphenyl, acenaphthene, methylacenaphthene, tetrahydroacenaphthene, dihydroanthracene, methylhydroanthracene, dimethylhydroanthracene, ethylhydroanthracene, tetrahydroanthracene, hexahydroanthracene, octahydroanthracene, dodecahydroanthracene, tetradecahydroanthracene, dihydrophenanthrene, methyldihydrophenanthrene, tetrahydrophenanthrene, hexahydrophenanthrene, octahydrophenanthrene, dodecahydrophenanthrene, tetradecahydrophenanthrene, dihydropyrene, tetrahydropyrene, hexahydropyrene, octahydropyrene, methyldihydropyrene, methyltetrahydropyrene, dihydrochrysene, tetrahydrochrysene, hexahydrochrysene, octahydrochrysene, decahydrochrysene, methyldihydrochrysene, methyltetrahydrochrysene, methylhexahydrochrysene, dimethyldihydrochrysene, dihydronaphthacene, tetrahydronaphthacene, hexahydronaphthacene, octahydronaphthacene, methyldihydronaphthacene, methyltetrahydronaphthacene, dihydroperylene, tetrahydroperylene, hexahydroperylene, octahydroperylene, dihydrodibenzanthracene, tetrahydrodibenzanthracene, hexahydrodibenzanthracene, dihydrobenzpyrene, tetrahydrobenzpyrene, hexahydrobenzpyrene, octahydrobenzpyrene, dihydrodibenzpyrene, tetrahydrodibenzpyrene, hexahydrodibenzpyrene, octahydrodibenzpyrene, dihydrocoronene, tetrahydrocoronene, hexahydrocoronene, octahydrocoronene and mixtures thereof. They may be used alone or in combination. Particularly preferred are aromatic-nucleus hydrogenated hydrocarbons obtained from bicyclic or tricyclic condensed aromatic hydrocarbons.

The hydrogenated oil (2) (b) used in this invention is prepared by contacting (i) a fraction boiling substantially at 160°-650° C., preferably 160°-400° C., more preferably 170°-350° C., produced as a by-product at the time of steam cracking naphtha, gas oil, kerosene or other petroleum usually at 700°-1200° C. to obtain ethylene, propylene and other olefins and/or (ii) a fraction boiling substantially at 160°-650° C., preferably 160°-400° C., more preferably 170°-350° C. produced at the time of heat treating a fraction boiling substantially at not lower than 200° C., preferably 200°-700° C., produced as a by-product at the time of steam cracking naphtha, gas oil, kerosene or other petroleum usually at 700°-1200° C. to produce ethylene, propylene and other olefins, with hydrogen in the presence of a hydrogenating catalyst to partly hydrogenate the aromatic nuclei of the aromatic hydrocarbons contained in said fraction (i) and/or said fraction (ii).

The hydrogenated oil (2) (c) used in this invention is prepared by contacting a fraction boiling substantially at 160°-650° C., preferably 160°-400° C., more preferably 170°-350° C., produced at the time of preparing the starting pitch by heat treatment, with hydrogen in the presence of a hydrogenating catalyst to partly hydrogenate the aromatic nuclei (10-70%) of the aromatic hydrocarbons contained in said fraction. The preparation of the hydrogenated oil (2) (c) will be explained in more detail hereunder.

With reference to FIG. 1 (which is a process chart showing the manufacture of the carbon fibers of this invention) in the accompanying drawing, the heavy fraction oil (1) for the starting pitch of this invention is introduced through line 1 into a system for preparing the starting pitch and the hydrogenated oil (2) (c) is also introduced through line 3 into said system. In the system these two oils are mixed together in the previously mentioned ratios and heat treated under the previously mentioned specified conditions to obtain a starting pitch. At this time of heat treatment, a fraction boiling at 160°-650° C. is withdrawn through line 2, partly hydrogenated at the nucleus of aromatic hydrocarbons contained and returned through line 3 to the system for use as one of the raw materials for the starting pitch.

The hydrogenated oil (2) (c) is not present at the initial stage in the practice of this invention, however, it is not long before the oil (2) (c) may be produced by collecting a fraction boiling at substantially 160°-650° C. at the time of heat treating another oil in substitution for the oil (2) (c) together with the heavy fraction oil (1) or the heavy fraction oil (1) alone and then hydrogenating the thus collected fraction to the extent that the nucleus of aromatic hydrocarbons contained therein is partly hydrogenated (such partial hydrogenation being hereinafter sometimes referred to as "partial nuclear hydrogenation"). The oil (2) (c) is prepared in this manner and supplied through the line 3 to the system, thus accomplishing this invention.

The other oil which may preferably be substituted for the oil (2) (c) at the said initial stage, includes a hydrogenated oil prepared by collecting a fraction boiling at 160°-650° C. at the time of fluidized catalytic cracking of petroleum and hydrogenating the thus collected fraction to effect partial nuclear hydrogenation therein, a hydrogenated oil prepared by collecting a fraction boiling at 160°-650° C. at the time of heat treating the heavy function oil (1) at 370°-480° C. and hydrogenating the thus collected fraction to effect partial nuclear hydrogenation therein, and a hydrogenated oil prepared by collecting a fraction boiling at 160°-650° C. produced at the time of heat treating a heavy fraction oil boiling at not lower than 200° C. obtained at the time of fluidized catalytic cracking of petroleum and hydrogenating the thus collected fraction to effect partial nuclear hydrogenation therein. The above partial nuclear hydrogenation is preferably 10-70% nuclear hydrogenation.

The hydrogenation carried out in the preparation of the hydrogenated oils (2) (b) and (2) (c) will be detailed hereinbelow.

The hydrogenating catalysts used herein may be those which are used in usual hydrogenating reactions. They include, for example, Group Ib metals such as copper, Group VIb metals such as chromium and molybdenum, Group VIII metals such as cobalt, nickel, palladium and platinum (Periodic Table), oxides or sulfides thereof, these metals and compounds being supported on an inorganic carrier such as bauxite, activated carbon, diatomaceous earth, zeolite, silica, titania, zirconia, alumina or silica gel.

The hydrogenating conditions will vary depending on the kind of a catalyst used, however, there are used a temperature of 120°-450° C., preferably 150°-350° C., and a pressure of 20-100 Kg/cm$^2$.G, preferably 30-70 Kg/cm$^2$.G. In cases where the hydrogenation is carried out batchwise, the suitable hydrogenating time is in the range of 0.5-3 hours; on the other hand, a liquid hourly space velocity (LHSV) of 0.5-3.0 is suitable for the continuous hydrogenation.

The hydrogenating conditions are exemplified as follows.

In cases where the hydrogenation is carried out batchwise in the presence of 2 wt.% Raney nickel as the catalyst, there may preferably be employed a pressure of 40-50 Kg/cm$^2$.G, a temperature of 160°-170° C. and a heat treating time of 1-1.5 hours; on the other hand, in cases where it is carried out continuously in the presence of a nickel.molybdenum catalyst, there may preferably be employed a pressure of 30-50 Kg/cm$^2$.G, a temperature of about 330° C. and a LHSV of about 1.5.

In the hydrogenation, it is necessary to hydrogenate 10-70%, preferably 15-50%, more preferably 15-35%, of the aromatic nuclei of the aromatic hydrocarbons contained in the fraction boiling at 160°-650° C. The aromatic nuclear hydrogenation ratio (such as the above 10-70% or 15-50%) is as defined by the following equation:

$$\text{Aromatic nuclear hydrogenation ratio} = \frac{\left(\begin{array}{c}\text{No. of carbons of}\\ \text{aromatic nucleus}\\ \text{before hydrogenation}\end{array}\right) - \left(\begin{array}{c}\text{No. of carbons of}\\ \text{aromatic nucleus}\\ \text{after hydrogenation}\end{array}\right)}{\begin{array}{c}\text{No. of carbons of aromatic}\\ \text{nucleus before hydrogenation}\end{array}}$$

wherein the number of aromatic nucleus is as indicated in ASTM D-2140-66.

It is necessary that the heavy fraction oil (1) and the hydrogenated oil (2) be mixed together in a mixing ratio by volume of 1:0.1-2, preferably 1:0.2-1.5. The heat treating temperature is in the range of 370°-480° C., preferably 390°-460° C. The heat treatment at lower than 370° C. will allow the reaction to proceed slowly and take a long time to complete the reaction, this being economically disadvantageous. The heat treatment at higher than 480° C. will undesirably raise problems as to coking and the like. The heat treating time will be determined in view of the heat treating temperature; a long time is necessary for the low treating temperature, while a short time for the high treating temperature. The heat treating time may be in the range of usually 15 minutes to 20 hours, preferably 30 minutes to 10 hours. The heat treating pressure is not particularly limited but preferably such that the effective ingredients of the hydrogenated oils in mixture are not distilled off without being reacted. Thus, the pressure may actually be in the range of 2-50 Kg/cm$^2$.G, preferably 5-30 Kg/cm$^2$.G.

The starting pitches obtained by the heat treatment of the hydrogenated oils in mixture may preferably be subjected to distillation or the like to remove the light fraction therefrom if necessary.

The thus obtained pitches of this invention may be heat treated to prepare thereof precursor pitches having a composition allowing the aromatic planes to be easily arranged in order while inhibiting the production of high-molecular-weight ingredients and preventing a raise in softening point. Thus, the precursor pitches so obtained may be used in producing carbon fibers having very excellent tensile modulus and tensile strength.

The starting pitches of this invention may be used in producing carbon fibers by the use of a conventional known method. More particularly, the starting pitch is heat treated to prepare a precursor pitch, after which the precursor pitch so obtained is melt spun, infusibilized and carbonized or further graphitized to obtain carbon fibers.

The heat treatment of the starting pitch to obtain a precursor pitch may usually be carried out at 340°-450° C., preferably 370°-420° C., in the stream of an inert gas such as nitrogen under atmospheric or reduced pressure. The time for the heat treatment may be varied depending on the heat treating temperature, the flow rate of the inert gas, and the like, however, it may usually be 1 minute-50 hours, preferably 1-50 hours, more preferably 3–20 hours. The flow rate of the inert gas may preferably be 0.7–5.0 scfh/lb pitch.

The method of melt spinning the precursor pitch may be a known method such as an extrusion, centrifugal or spraying method. The spinning temperature may usually be 150°–350° C., preferably 200°–330° C.

The pitch fibers obtained by melt spinning the starting pitch are then infusibilized in an oxidizing atmosphere. The oxidizing gases which may usually be used herein, include oxygen, ozone, air, nitrogen oxides, halogen and sulfurous acid gas. These oxidizing gases may be used singly or in combination. The infusibilizing treatment may be effected at such a temperature that the pitch fibers obtained by melt spinning are neither softened nor deformed; thus, the infusibilizing temperature may be, for example, 20°–360° C. The time for the infusibilization may usually be in the range of 5 minutes to 10 hours.

The pitch fibers so infusibilized are then carbonized or further graphitized to obtain carbon fibers. The carbonization may usually be carried out at 800°–2500° C. for generally 0.5 minutes to 10 hours. The further graphitization may be carried out at 2500°–3500° C. for usually 1 second to 1 hour.

Further, the infusibilization, carbonization or graphitization may be effected with some suitable load or tension being applied to the mass to be treated in order to prevent the mass from shrinkage, deformation and the like.

This invention will be better understood by the following non-limitative examples and comparative examples.

EXAMPLE 1

Fifty (50) parts by volume of a heavy fraction oil (having distillation characterstics as shown in Table 1) boiling at not lower than 200° C. produced as a by-product at the time of steam cracking a naphtha at 830° C. were mixed with 50 parts by volume of tetralin to form a mixture which was then heat treated at 430° C. under a pressure of 20 Kg/cm$^2$.G for 3 hours. The thus heat treated oil was distilled at 250° C. under a pressure of 1.0 mmHg to remove the light fraction therefrom thereby obtaining a starting pitch of this invention having a softening point of 55° C. and containing 1% of benzene-insoluble ingredients.

Then, 30 g of the thus obtained starting pitch were heat treated at 400° C. under agitation for 10 hours while blowing nitrogen thereto at a flow rate of 600 ml/min. thereby to obtain a pitch having a softening point of 278° C. and containing 25 wt.% of quinoline-insoluble ingredients and 55% of mesophase. This precursor pitch was melt spun at 334° C. by the use of a spinner having 0.3 mm-diameter nozzles and L/D=2 to obtain pitch fibers of 13–16$\mu$ in diameter which were then infusibilized, carbonized and graphitized to obtain carbon fibers.

The infusibilization, carbonization and graphitization were carried out under the following conditions.

Infusibilizing conditions: Raised at 3° C./min. to 200° C., then at 1° C./min. to 300° C. and maintained at 300° C. for 15 minutes in air.

Carbonizing conditions: Raised at 5° C./min. to 1000° C. and maintained at this temperature for 30 minutes in a nitrogen atmosphere.

Graphitizing conditions: Raised at 25° C./min. to 2500° C. for heat treatment in an argon stream.

The carbon fibers so obtained had a tensile strength of 235 Kg/mm$^2$ and a tensile modulus of 36 ton/mm$^2$.

TABLE 1

| Distillation Characteristics of Heavy Fraction Oil | | |
|---|---|---|
| Specific gravity (15° C./4° C.) | | 1.039 |
| Distillation characteristics | Initial boiling point | 192(°C.) |
| | 5% | 200 |
| | 10% | 206 |
| | 20% | 217 |
| | 30% | 227 |
| | 40% | 241 |
| | 50% | 263 |
| | 60% | 290 |
| | 70% | 360 |

Comparative Example 1

The same heavy fraction oil as used in Example 1 was heat treated at 400° C. under a pressure of 15 Kg/cm$^2$.G for 3 hours. The thus heat treated oil was distilled at 250° C. under a pressure of 1.0 mmHg to distil off the light fraction therefrom thereby obtaining a starting pitch having a softening point of 82° C.

The thus obtained starting pitch was then heat treated in the same manner as in Example 1 to obtain a pitch having a softening point of 318° C. and containing 59 wt.% of quinoline-insoluble ingredients and 97% of mesophase. This pitch was melt spun at 368° C. by the use of the spinner used in Example 1 to obtain pitch fibers of 18–24$\mu$ in diameter which were infusibilized, carbonized and graphitized to obtain carbon fibers having a tensile strength of 110 Kg/mm$^2$ and a tensile modulus of 14 ton/mm$^2$.

Comparative Example 2

The procedure of Example 1 was followed except that Ashland 240 LS (which was a commercially available petroleum pitch having a softening point of 120° C.) was substituted for the starting pitch of this invention. The pitch thus heat treated contained 50% of mesophase.

The carbon fibers finally obtained had a tensile strength of 137 Kg/mm$^2$ and a tensile modulus of 28 ton/mm$^2$.

Example 2

Eighty (80) parts by volume of the same heavy fraction oil as used in Example 1 were mixed with 20 parts by volume of dihydroanthracene to form a mixture which was then heat treated at 430° C. under a pressure of 15 Kg/cm$^2$.G for 2 hours. The thus heat treated oil was distilled at 250° C./1.0 mmHg to distil off the light fraction to obtain a starting pitch of this invention having a softening point of 65° C.

The thus obtained starting pitch was heat treated in the same manner as in Example 1 to obtain a pitch having a softening point of 283° C. and containing 28 wt.% of quinoline-insoluble ingredients and 63% of mesophase. This pitch was melt spun at 331° C. by the use of the spinner used in Example 1 to obtain pitch fibers of 11–18$\mu$ in diameter which were then infusibilized, carbonized, and graphitized in the same manner as in Example 1 to obtain carbon fibers. The thus obtained carbon fibers had a tensile strength of 260 Kg/mm$^2$ and a tensile modulus of 38 ton/mm$^2$.

Comparative Example 3

The procedure of Example 2 was followed except that the mixture of the heavy fraction oil and dihydroanthracene was heat treated at 360° C., thereby to obtain carbon fibers. The carbon fibers so obtained had a tensile strength of 186 Kg/mm$^2$ and a tensile modulus of 21 ton/mm$^2$.

Comparative Example 4

The procedure of Example 2 was followed except that the mixture of the heavy fraction oil and dihydroanthrancene was heat treated at 500° C. for 0.5 hours with the result that carbonaceous substances were deposited in the reactor and a uniform starting pitch could not be obtained.

Example 3

The same heavy fraction oil (having distillation characteristics as shown in Table 1) as obtained in Example 1 was provided.

The heavy fraction oil [hereinafter called "heavy fraction oil (A)"] so provided was heat treated at 400° C. under a pressure of 15 Kg/cm$^2$.G for 3 hours and then distilled at 250° C. under a pressure of 1 mmHg to collect a fraction (B) boiling at 160°–400° C. having distillation characteristics as shown in Table 2.

TABLE 2

| Distillation Characteristics of Fraction (B) | | |
|---|---|---|
| Specific gravity (15° C./4° C.) | | 0.991 |
| Refractive index ($n_D^{25}$) | | 1.5965 |
| Molecular weight | | 145 |
| Distillation characteristics | Initial boiling point | 160(°C.) |
| | 10% | 200 |
| | 30% | 215 |
| | 50% | 230 |
| | 70% | 256 |
| | 90% | 305 |

The thus collected fraction (B) was contacted with hydrogen at 330° C. under a pressure of 35 Kg/cm$^2$.G at a LHSV of 1.5 in the presence of a nickel.molybdenum catalyst (NM-502) to partly hydrogenate the nucleus of the aromatic hydrocarbons contained in the fraction (B) thereby to obtain a hydrogenated oil (C) having an aromatic nuclear hydrogenation ratio of 31%.

Then, 50 parts by volume of the heavy fraction oil (A) were mixed with 50 parts by volume of the hydrogenated oil (C) and then heat treated at 430° C. under a pressure of 20 Kg/cm$^2$.G for 3 hours. The mixed oil so heat treated was distilled at 250° C. under a pressure of 1.0 mmHg to remove the light fraction therefrom thereby obtaining a starting pitch of this invention having a softening point of 54° C. and containing 0.9 wt.% of benzene-insoluble ingredients.

Thereafter, 30 g of the thus obtained starting pitch were heat treated at 400° C. under agitation for 10 hours while blowing nitrogen thereto at a flow rate of 550 ml/min. to obtain a pitch having a softening point of 274° C. and containing 19.5 wt.% of quinoline-insoluble ingredients and 53% of mesophase. This pitch was melt spun at 334° C. by the use of a spinner having 0.3 mm-diameter nozzles and L/D=2, to produce pitch fibers of 11–15$\mu$ in diameter which were then infusibilized, carbonized and graphitized under the following conditions to obtain carbon fibers.

Infusibilizing conditions: Raised at 3° C./min. to 200° C., then at 1° C./min. to 300° C. and maintained at 300° C. for 10 minutes in air.

Carbonizing conditions: Raised at 10° C./min. to 1000° C. and maintained at this temperature for 30 minutes in a nitrogen atmosphere.

Graphitizing conditions: Raised at 50° C./min. to 2500° C. in an argon stream.

The thus obtained carbon fibers had a tensile strength of 250 Kg/mm$^2$ and a tensile modulus of 37.5 ton/mm$^2$.

Comparative Example 5

The same heavy fraction oil (A) as used in Example 3 was heat treated at 400° C. under a pressure of 15 Kg/cm$^2$.G for 3 hours. The thus heat treated oil was distilled at 250° C./1 mmHg to distil off the light fraction therefrom to obtain a starting pitch having a softening point of 82° C.

The starting pitch so obtained was heat treated in the same manner as in Example 3 to obtain a pitch having a softening point of 321° C. and containing 57 wt.% of quinoline-insoluble ingredients and 98% of mesophase. The pitch so heat treated was melt spun at 367° C. by the use of the spinner used in Example 3 to obtain pitch fibers of 17–25$\mu$ in diameter which were then infusibilized, carbonized and graphitized in the same manner as in Example 3 to obtain carbon fibers. The thus obtained carbon fibers had a tensile strength of 120 Kg/mm$^2$ and a tensile modulus of 15 ton/mm$^2$.

Example 4

A fraction (D) boiling at 160°–400° C. was collected as a by-product produced at the time of steam cracking of naphtha at 830° C. The distillation characteristics of the fraction (D) is as shown in Table 3. The fraction (D) was contacted with hydrogen at 330° C., 35 Kg/cm$^2$.G and a LHSV of 1.0 to partly hydrogenate the aromatic nucleus of aromatic hydrocarbons contained in said fraction thereby obtaining a hydrogenated oil (E) having an aromatic nuclear hydrogenation ratio of 24%.

Then, 60 parts by volume of the same heavy fraction oil (A) as used in Example 3 were mixed with 40 parts by volume of the hydrogenated oil (E) and the resulting mixture was heat treated at 430° C. and 15 Kg/cm$^2$.G for 2 hours. The mixed oil so heat treated was distilled at 250° C./1.0 mmHg to distil off the light fraction therefrom thereby obtaining a starting pitch of this invention.

The thus obtained starting pitch was heat treated in the same manner as in Example 3 to obtain a pitch having a softening point of 281° C. and containing 28.3 wt.% of quinoline-insoluble ingredients and 62% of mesophase. This pitch was melt spun at 340° C. by the use of the spinner used in Example 3 to obtain pitch fibers of 11–16$\mu$ in diameter which were then infusibilized, carbonized and graphitized to obtain carbon fibers having a tensile strength of 267 Kg/mm$^2$ and a tensile modulus of 39 ton/mm$^2$.

TABLE 3

| Distillation Characteristics of Fraction (D) | | |
|---|---|---|
| Specific gravity (15° C./4° C.) | | 1.02 |
| Refractive index ($n_D^{25}$) | | 1.5867 |
| Distillation characteristics | Initial boiling point | 163(°C.) |
| | 10% | 208 |
| | 30% | 226 |
| | 50% | 239 |
| | 70% | 262 |

TABLE 3-continued

| Distillation Characteristics of Fraction (D) | |
|---|---|
| 90% | 317 |

Example 5

There was collected a heavy fraction oil (A) boiling at not lower than 200° C. produced as a by-product at the time of steam cracking of naphtha at 830° C. The thus collected heavy fraction oil (A) was the same as that used in Example 1 and had distillation characteristics as shown in Table 1. The oil (A) was then heat treated at 400° C. and 15 Kg/cm$^2$.G for 3 hours. The thus heat treated oil (B) was distilled at 250° C./1.0 mmHg to remove the light fraction therefrom thereby obtaining a pitch (I) having a softening point of 82° C.

Separately, there was collected a fraction (C) boiling at 160°-400° C. from the light fraction obtained by distilling the heat treated oil (B) at 250° C./1.0 mmHg. The fraction (C) had distillation characteristics as shown in Table 4. The fraction (C) was contacted with hydrogen at 330° C., 35 Kg/cm$^2$.G and a LHSV of 1.5 in the presence of a nickel.molybdenum catalyst (NM-502) to effect the partial nuclear hydrogenation in the fraction (C) to obtain a hydrogenated oil (D) having an aromatic nuclear hydrogenation ratio of 31%.

TABLE 4

| Distillation Characteristics of Fraction (C) | | |
|---|---|---|
| Specific gravity (15° C./4° C.) | | 0.991 |
| Refractive index | | 1.5965 |
| Average molecular weight | | 145 |
| Distillation characteristics | Initial boiling point | 160(°C.) |
| | 10% | 200 |
| | 30% | 215 |
| | 50% | 230 |
| | 70% | 256 |
| | 90% | 305 |

Then, 60 parts by volume of the heavy fraction oil (A) were mixed with 40 parts by volume of the hydrogenated oil (D) and the resulting mixed oil was heat treated at 415° C. and 15 Kg/cm$^2$.G for 3 hours. The thus heat treated oil (E) was distilled to remove the light fraction therefrom to obtain a pitch (II) having a softening point of 57° C.

A fraction (F) boiling at 160°-400° C. was collected from the light fraction obtained by distilling the oil (E) at 250° C/1.0 mmHg. The fraction (F) so collected had distillation characteristics as indicated in Table 5.

TABLE 5

| Distillation Characteristics of Fraction (F) | | |
|---|---|---|
| Specific gravity (15° C./4° C.) | | 1.002 |
| Refractive index ($n_D^{25}$) | | 1.5867 |
| Distillation characteristics | Initial boiling point | 163(°C.) |
| | 10% | 208 |
| | 30% | 226 |
| | 50% | 239 |
| | 70% | 262 |
| | 90% | 317 |

Then, 2 wt.% of Raney nickel was suspended in the fraction (F) and this fraction was hydrogenated at 167° C. under a hydrogen pressure of 40-50 Kg/cm$^2$.G for 2 hours to effect partial nuclear hydrogenation therein to obtain a hydrogenated oil (G) having an aromatic nuclear hydrogenation ratio of 35%.

Seventy (70) parts by volume of the heavy fraction oil (A) were mixed with 30 parts by volume of the hydrogenated oil (G) and the resulting mixed oil was heat treated at 420° C. and 15 Kg/cm$^2$.G for 3 hours. The thus heat treated mixed oil was distilled at 250° C./1.0 mmHg to remove the light fraction therefrom thereby obtaining a starting pitch having a softening point of 59° C.

Then, 30 g of the thus obtained starting pitch were heat treated at 400° C. under agitation for 10 hours while blowing nitrogen gas thereto at a flow rate of 500 ml/min. to obtain a pitch having a softening point of 291° C. and containing 29 wt.% of quinoline-insoluble ingredients and 66% of mesophase. This pitch was melt spun at 350° C. by the use of a spinner having 0.3 mm-diameter nozzles and L/D=1 to obtain pitch fibers of 10-15$\mu$ in diameter which were then infusibilized, carbonized and graphitized to obtain carbon fibers.

The treating conditions for the infusibilization, carbonization and graphitization were as follows.

Infusibilizing conditions: Raised at 3° C./min. to 200° C., then at 1° C./min. to 300° C. and maintained at 300° C. for 10 minutes in air.

Carbonizing conditions: Raised at 10° C./min. to 1000° C. and maintained at this temperature for 20 minutes in a nitrogen atmosphere.

Graphitizing conditions: Raised at 50° C./min. to 2500° C. in an argon stream.

The carbon fibers so obtained had a tensile strength of 273 Kg/mm$^2$ and a tensile modulus of 42 ton/mm$^2$.

Comparative Example 6

The pitch (I) as obtained in Example 5, which was used as the starting pitch, was heat treated in the same manner as in Example 5 to obtain a pitch having a softening point of 320° C. and containing 59 wt.% of quinoline-insoluble ingredients and 98% of mesophase. This pitch was melt spun at 367° C. by the use of the spinner used in Example 5 to obtain pitch fibers of 16-23$\mu$ in diameter which were infusibilized, carbonized and graphitized in the same manner as in Example 5 to obtain carbon fibers.

The thus obtained carbon fibers had a tensile strength of 115 Kg/mm$^2$ and a tensile modulus of 16 ton/mm$^2$.

What is claimed is:

1. A process for the production of carbon fibers which comprises heat treating a starting pitch to obtain a precursor pitch, melt spinning the thus obtained precursor pitch, infusibilizing the thus spun pitch, carbonizing the thus infusibilized pitch, and if desired, graphitizing the thus carbonated pitch, wherein the starting pitch is produced by the following method:

(A) mixing 100 parts by volume of (1) a heavy fraction oil boiling at not lower than 200° C. obtained at the time of steam cracking of petroleum with 10-200 parts by volume of (2) a hydrogenated oil selected from the group consisting of:

(a) aromatic nucleus hydrogenated hydrocarbons prepared from aromatic hydrocarbons of 2-10 rings by hydrogenating the aromatic nucleus thereof;

(b) a hydrogenated oil obtained by contacting a fraction oil boiling at 160°-650° C. produced at the time of heat treating, at 370°-480° C., a heavy fraction oil boiling at not lower than 200° C. obtained at the time of steam cracking a fraction and/or petroleum boiling at 160°-650° C. obtained at the time of steam cracking petroleum, with hydrogen in the presence of a hydrogenating catalyst to hydrogenate 10–70% of the aromatic nucleus of aromatic hydrocarbons contained in said fraction boiling at 160°–650° C.; and (c) a hydrogenated oil obtained by contacting a fraction boiling at 160°–650° C. produced at the time of preparing the starting pitches by heat treatment, with hydrogen in the presence of a hydrogenating catalyst to hydrogenate 10–70% of the aromatic nuclei of aromatic hydrocarbons contained in said fraction boiling at 160°–650° C., to form a mixture of the oils (1) and (2), and then (B) heat treating the thus formed oil mixture at 370°–480° C. under a pressure of 2–50 kg/cm$^2$.G thereby to obtain the starting pitch.

2. A process for the production of carbon fibers according to claim 1, wherein the hydrogenated oil (2)(c) is a hydrogenated oil prepared by collecting a fraction boiling at 160°–650° C. at the time of fluidized catalytic cracking of petroleum and hydrogenating the thus collected fraction to effect 10–70% nuclear hydrogenation therein, a hydrogenated oil prepared by collecting a fraction boiling at 160°–650° C. at the time of heat treating a heavy fraction oil (1) at 370°–480° C. and hydrogenating the thus collected fraction to effect 10–70% nuclear hydrogenation therein, or a hydrogenated oil prepared by collecting a fraction boiling at 160°–650° C. produced at the time of heat treating a heavy fraction oil boiling at not lower than 200° C. obtained at the time of fluidized catalytic cracking of petroleum and hydrogenating the thus collected fraction to effect 10–70% nuclear hydrogenation therein.

* * * * *